United States Patent [19]

Barker

[11] 4,228,346

[45] Oct. 14, 1980

[54] SELF-CALIBRATING ELECTRIC CLOCK CIRCUIT

[75] Inventor: Charles E. Barker, Holland, Mich.

[73] Assignee: Robertshaw Controls Company, Richmond, Va.

[21] Appl. No.: 907,550

[22] Filed: May 19, 1978

[51] Int. Cl.[3] ..... G06M 3/12

[52] U.S. Cl. ..... 235/92 T; 235/92 MS; 368/79

[58] Field of Search ..... 235/92 T, 92 FP, 92 MS; 58/23 R, 23 BA, 23 AC

[56] References Cited

U.S. PATENT DOCUMENTS

| | | | |
|---|---|---|---|
| 3,889,461 | 6/1975 | Marti et al. | 58/23 BA |
| 3,946,219 | 3/1976 | Lucas | 235/92 FP |
| 4,031,363 | 6/1977 | Freeman et al. | 235/92 T |
| 4,040,247 | 8/1977 | Haydon | 58/23 BA |

*Primary Examiner*—Joseph M. Thesz

*Attorney, Agent, or Firm*—Fulwider, Patton, Rieber, Lee & Utecht

[57] ABSTRACT

A clock circuit designed to keep time based upon a known frequency of an alternating current power supply is provided with a d.c. power backup system to operate the clock circuit during periods of a.c. power failure. The clock circuit includes a high frequency oscillator which generates a large number of timing pulses for each alternating current power cycle. During periods of normal operation on alternating current power, the number of oscillator timing pulses occurring between successive null points in the alternating current power supply waveform are counted and stored. When the clock circuit is operated from the d.c. power supply during periods of a.c. power failure, the last count of timing pulses between successive null points in the a.c. cycle is loaded as an initial count into a counter. The counter is decremented down to zero, whereupon the counter registers the passage of a period of time corresponding to the time interval between two null points in the a.c. power cycle, at that time no longer present. This count is used to update a time recorder to maintain accurate time even during periods of power failure.

7 Claims, 2 Drawing Figures

SELF-CALIBRATING ELECTRIC CLOCK CIRCUIT

BACKGROUND OF THE INVENTION

1. Field of the Invention

The present invention relates to automatic calibration of clock circuits normally powered by alternating current of a uniform known frequency during periods of interruption.

2. Description of the Prior Art

Electric clock circuits have been utilized for many years to power timekeeping devices, such as electric clocks automatic ovens, automatic locks, and so forth. More recently, electric clock circuitry has been employed to govern periodic operations in thermostat heating and cooling control systems. For example, night setback thermostat systems have been developed for use in home and office heating and air conditioning to maintain a preset daytime temperature during certain hours of the day, and to thereafter maintain a lower temperature during the night. Such systems tend to conserve energy, since cooler temperatures are generally more desirable at nighttime. This is true with respect to buildings in which occupants sleep and in buildings which are vacated during the night, but within which a minimum temperature must be maintained to prevent damage to plumbing fixtures. The same type of timing circuitry is applied to allow an increase in temperature at night when operating an air conditioning system in which a building is vacated during the night hours. In either event, an automatic time keeping system is necessary to ensure that the appropriate set point temperature changes occur at the scheduled times.

Most conventional electrical timekeeping devices operate from commercially available alternating current provided by electrical utilities. This current is typically at 110 to 120 volts and is provided as a sinusoidal current of a fixed frequency, usually 60 hertz. There are some localities in which the cyclic frequency is 50 hertz. Whatever the frequency, within a given location frequency is maintained constant.

In the electrical timepieces driven by such alternating current, the current is provided to an electric motor to rotate a shaft carrying an armature at a rate determined by the frequency rate of the alternating current provided. Naturally, a temporary interruption in alternating current service removes the power input to such timekeeping devices, which thereafter remain dormant until power is restored. In such instances of power failure or interruption, the timepieces must be manually reset by reference to a clock not subject to the power failure.

More recently, some types of electrical timekeeping devices have been operated from direct current power sources. With the advent of minaturized LSI circuitry, electrical wrist watches and clocks and other chronometers are operated from direct current power supplies. In such devices, the d.c. power supply either operates a d.c. motor to turn a shaft and armature, or the d.c. power supply powers an oscillator, such as a high frequency crystal oscillator, to provide a series of timing pulses occurring at uniform intervals. Time pieces driven by electric d.c. motors are notoriously inaccurate since, as the voltage level of the d.c. power source deteriorates with use, the motor speed slows. This causes the electric timepiece to lose time, so that it must be continually corrected by manual compensation. Those systems employing crystal oscillators to produce timing signals likewise suffer from certain deficiencies. Specifically, as the d.c. voltage level falls with deterioration of the d.c. voltage source, a threshold level is reached below which the voltage and current available are insufficient to drive the oscillator. The result is, in effect, a power failure to the time keeping mechanism.

SUMMARY OF THE INVENTION

The present invention is a method for maintaining the accuracy of an electric timepiece. The method of the invention of automatic time calibration has the advantages of utilizing the long term stability provided by a commercially available a.c. electric power source, but also accommodates operation on an emergency or backup a.c. power system during periods of a.c. power failure. Because such periods of backup operation are usually relatively short in duration, the disadvantages of operation from a d.c. power supply do not occur.

A further object of the invention is to combine the advantages of a.c. and d.c. electric clock circuit operation, and to additionally provide automatic calibration so that there is no divergence between the rate at which the timekeeping device is driven on alternating current and the rate at which it is driven by a backup d.c. power supply.

The foregoing advantages are achieved through the method of the present invention, which utilizes a crystal oscillator that is driven during normal conditions from an a.c. power supply, but rectified to effectuate d.c. operation. The crystal oscillator provides a stream of high frequency timing pulses. During normal operation of the clock circuit from the a.c. supply, zero or null point crossings of the sinusiodial a.c. waveform are detected and the number of oscillator timing pulses occuring between sequential null point crossings is tabulated and stored. During normal a.c. operation, this stored number of timing pulses is not utilized. However, when the a.c. line frequency is absent and the system is operated from a d.c. supply, this number is loaded into a counter. The oscillator timing pulses, which are produced under power from the backup d.c. supply, are supplied on a decrementing lead of the counter. Each time the counter counts down to zero, a time recorder register is incremented, thereby indicating the elapsed period of time associated with the time duration between sequential null points crossings of the normally present a.c. waveform. In normal a.c. operation, the detection of these a.c. null point crossings would increment the time recorder register. Thus, the same result is achieved regardless of whether the clock circuit is operating normally under a.c. power, or whether it is operating from a standby d.c. power source.

Because there is typically some deviation in the intervals between specific sequential null points in commercially available alternating current waveforms, the exact number of timing pulses stored in association with sequential null point crossings will vary. Commercial power utilities usually ensure that there is negligible frequency variation over an extended period, such as 24 hours. However, because frequency may vary slightly throughout the course of a day, and because the last available period between waveform null points is used as the reference for automatic calibration, some form of compensation is desirable.

The simplest manner of preventing variations in the number of timing pulses counted between sequential null point crossings from having adverse effects on the time recorder when the system is operating in the backup d.c. power mode is to ensure that the timing pulses occur at a much greater frequency as contrasted with the frequency of the a.c. power supply. Preferably, where the a.c. power supply is 60 hertz, the frequency of the oscillator timing pulses is at least one kilohertz, and preferably is about 100 kilohertz. This high frequency ratio ensures that although there may be some variation in the number of timing pulses occuring between sequential null point crossings, the variation represents only a very minor percentage of the timing pulses counted. Thus, although the last available waveform from which timing pulses are counted may deviate somewhat from the frequency of 60 hertz, the error introduced into the time recorder is negligible. Even the cummulative error which would result from continued d.c. operation would not be great, since power outages usually do not occur for longer than a few hours at a time.

Another form of compensation for a.c. frequency variation is to calculate the number of timing pulses from a particular oscillator that will occur between null points and to store this number in permanent memory for use during operation of the clock circuit in the d.c. backup mode.

In most applications of the self calibrating clock circuit, the clocking mechanism is but a part of an overall cyclic control system, such as a night setback thermostat system. Preferably, therefore, the operation of the clock circuit is but a part of the operation of a LSI microprocessor device. One such suitable device is the model PPS-4/1 MM76 microcomputer manufactured by Rockwell International Coproration, Micro-Electronic Device Division, 3310 Miraloma Avenue, Anaheim, California 92803. The timing pulse outputs of the crystal oscillator are provided at the clock input pin of the MM76 microcomputer, which is pin 3.

The manner of performance of the method of the present invention may be illustrated with greater clarity and particularity by reference to the accompanying illustrations.

DESCRIPTION OF THE IMPLEMENTATION

The method of the invention resides in the self-calibration of an electric clock circuit in a time keeping device which is operated by alternating current, such as is commercially available from electrical utilities as a 110–120 60 hertz supply. The method is designed for use with a clock circuit which also employs a direct current backup electrical power source, such as rechargeable nickel cadmium batteries. An oscillator, such as a 100 kilohertz crystal oscillator for generating timing pulses of greater frequency than the alternating current supply is also provided. The output of the clock circuit includes a time recorder, such as binary to decimal conversion data latch to register elapsed time. Within the clock circuit, a pulse counter is used to count timing pulses from the crystal oscillator.

Figure 2:
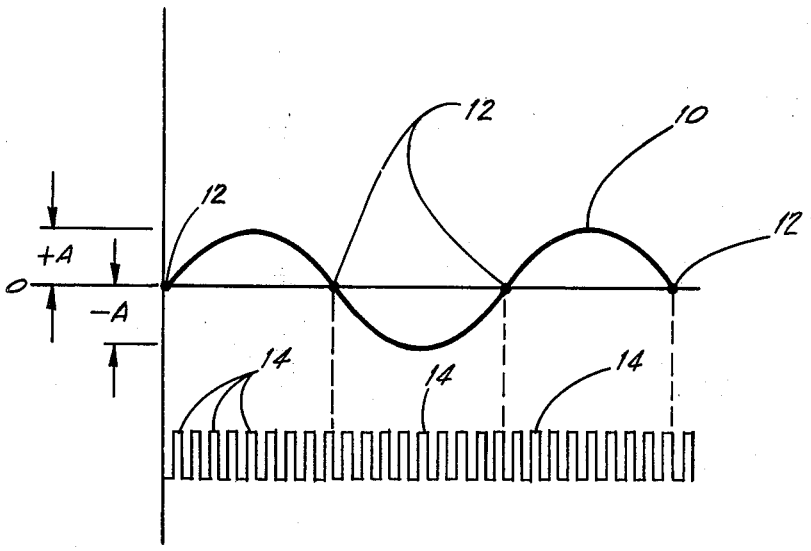
FIG. 2 is a timing diagram illustrating the relationship between alternating current and timing pulse signals.

The alternating current signal is depicted as a sinuisoidal waveform 10 in FIG. 2. The opposing peaks of the sinusoidal waveform 10 achieve an amplitude of +A and an amplitude of −A of opposite polarity relative to a 0 or null level, as indicated. The null point crossings of the wave form 10 are designated at 12. The output of the 100 kilohertz external clock connected as an input to pin 3 of the MM76 microcomputer transmits without interruption a series of timing pulse spikes 14 of uniform pulse width and uniform duration and frequency. For the sake of clarity of illustration, the pictorial depiction of the number of timing pulse spikes 14 occurring between any two sequential null points 12 is greatly reduced. In actuality, 10,000 of the timing pulses 14 occur during each second, so that when the alternating current cycle wave-form 10 is a 60 cycle commercial line current, approximately 833 of the timing pulses 14 occur between sequential null points 12.

Figure 1:
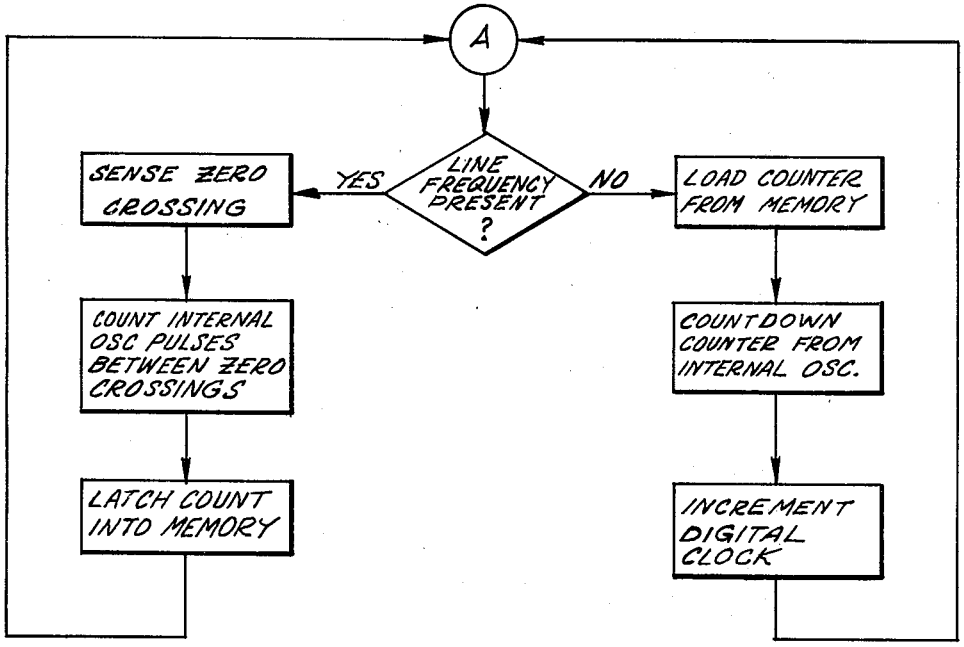
FIG. 1 is a flow chart of the steps of one method of implementation of the invention.

The MM76 microcomputer includes a program subroutine which performs the steps of the method of the invention. The subroutine beginning is indicated at A in FIG. 1, which symbolizes loading of the program subroutine into the instruction decoder of the MM76. The program instructions are loaded one at a time into the instruction decoder from permanent memory storage in the read only memory of the MM76. Upon initiation of the program, a comparison is performed in the accumulator of the MM76 to determine whether or not the line current of alternating frequency of waveform depicted at 10 in FIG. 2 is present. The presence or absence of this line current is signalled through one of the input/output ports of the MM76. The accumulator thereby tests for the existence of the constant frequency alternating current.

If it is determined that the alternating current is present, the MM76 ascertains and stores the number of timing pulses 14 occurring between successive null point crossings 12 in a half cycle of the alternating current waveform 10. This is accomplished by detecting sequential null points 12 in the alternating current, typically through another of the input/output ports of the MM76. Successive null points 12 trigger a flip flop circuit, one of the outputs of which is an enabling line to an internal counter. The counter may be merely a portion of the accumulator of the MM76. Once the counter is enabled, the high frequency timing pulses 14 between sequential null points 12 are counted as long as the counter remains enabled. Upon registration of the second of two successive null points 12, the enable line to the counter goes low and the counter stops counting oscillator pulses 14 and the counter contents are transferred into storage. Storage is normally in the random access memory of the MM76. Thereafter, the MM76 will normally branch to a different program subroutine. However, when the calibration subroutine of the electric clock circuit is again called upon, performance of the program steps will again begin at the program instruction starting point A in FIG. 1. The foregoing subroutine steps are repeated in the order as described as long as the alternating current wave form 10 is present. Each count of timing pulses 14 is latched into memory and over-written upon any previously stored count, so that only a single series of memory bit locations are used for storage of the oscillator pulse count in the RAM.

At the inception of the performance of the program steps, during periods of power failure, the accumulator of the MM76 will determine that the line frequency wave-form 10 is no longer present. As a result, different program steps are performed. Specifically, a counter, such as a counter in the accumulator is loaded with the previously stored count of timing pulses 14 from the RAM of the MM76. Thereafter, the timing pulses 14 from the oscillator, then powered by the d.c. output of the backup electrical storage batteries, is gated through the decrementing line of the counter. The counter is counted down until the counter contents reaches zero. When this occurs, the time recorder, which is normally a digital clock is updated to register the passage of a time increment corresponding to the time increment between null points 12 of the alternating current waveform 10, which at that time is no longer present. In this way the digital clock, connected to the output of the accumulator counter, is able to maintain the correct time of day, even in the absence of alternating line current.

Typically the digital clock is connected to a display so that a visual indication of time of day is displayed as tabulated by the time recorder. Alternatively, or in addition, the digital clock may be connected to a process control, such as a thermostat set point control. A lapse of a predetermined interval of time, as registered in the digital clock, will ultimately actuate such an external control to cause any desired control operation to occur.

While but a single implementation of the method of the invention has been described in detail, it should be understood that numerous variations and modifications will become readily apparent to those familiar with clock circuits. For example, rather than counting down the counter to zero using the timing pulses 14, two counters could be employed, the first could be loaded with the previously stored count of timing pulses 14 occurring between two null points 12 from the random access memory of the microcomputer. The other counter could be counted up by timing pulses 14 as currently detected. The counter outputs could be connected to a comparator, so that when the requisite number of timing pulses 14 had been achieved, the time recorder could be updated by the comparator output. Also, rather than continuously updating the contents of the number of timing pulses 14 occurring between sequential null points 12, as heretofore described, a single number could be chosen to represent an accurate number of timing pulses 14 which should occur between sequential null points 12 in an alternating current cycle. This number could be stored, either in the random access memory, or in permanent storage in the read only memory in the microcomputer.

Because of the various techniques which can be used to implement the steps of the invention, the invention should not be construed as limited to the specific implementation suggested herein. Rather, the scope of the invention is defined in the claims appended hereto.

What is claimed is:

1. A method of self calibrating an electric clock circuit operated by a power source providing constant frequency alternating current and employing a direct current backup electrical power source, a high frequency oscillator for generating timing pulses of greater frequency than said alternating current, a time recorder for registering elapsed time, and by updating said time recorder with the elapse of cyclical periods of said alternating current comprising defining the duration of the periods of said constant frequency alternating current source in terms of a number of pulse counts from said high frequency oscillator by:

(a) repetitively testing for the existence of said constant frequency alternating current, and upon detecting the presence of said alternating current, (b) ascertaining and storing the number of oscillator pulses from said high frequency oscillator occuring between successive repetition points in a cycle of said alternating current, (c) in the absence of detection of the existence of said alternating current, (i) loading said counter with said number of oscillator pulses that occurred between said successive repetition points, (ii) strobing said counter with said high frequency oscillator to change the contents thereof in a single direction of advancement incrementally with each oscillator pulse, and (iii) updating said time recorder upon advancing said counter to a limit, and retesting for the presence of said constant frequency alternating current.

2. The method according to claim 1 further characterized in that said step of ascertaining said number of timing pulses and storing is performed by detecting sequential null points in said alternating current, counting said high frequency timing pulses between sequential null points, storing the number of timing pulses counted between sequential null points, and thereafter repetitiously performing said step of testing and said step of ascertaining and storing when said alternating current is present.

3. The method according to claim 1 further characterized in that said step of altering the contents of said counter is performed by decrementing said counter, and wherein updating said time recorder is performed when said counter is empty.

4. The method of claim 1 further comprising providing said alternating current as a 60 hertz sinusoidal signal, and generating said timing pulses at at least a frequency of one kilohertz.

5. The method of claim 4 further comprising generating said timing pulses at a frequency of 100 kilohertz.

6. The method of claim 1 further comprising displaying a visual indication time of day as tabulated by said time recorder.

7. The method of claim 1 further comprising actuating a control following elapse of a predetermined interval of time as registerd in said time recorder.

* * * * *